US006737979B1

(12) United States Patent
Smith et al.

(10) Patent No.: US 6,737,979 B1
(45) Date of Patent: May 18, 2004

(54) MICROMECHANICAL SHOCK SENSOR

(75) Inventors: Gabriel L. Smith, Waldorf, MD (US); Lawrence Fan, Vienna, VA (US); Ralph E. Balestrieri, Dunkirk, MD (US); Daniel L. Jean, Odenton, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 194 days.

(21) Appl. No.: 10/021,700

(22) Filed: Dec. 4, 2001

(51) Int. Cl.[7] ..... G08B 21/00

(52) U.S. Cl. ..... 340/665; 340/666; 340/669; 340/689; 340/686.6; 340/691.7; 340/672

(58) Field of Search ..... 340/665, 666, 340/669, 670, 671, 672, 673, 674, 682, 683, 689, 686.6, 691.7, 571

(56) References Cited

U.S. PATENT DOCUMENTS 4,470,302 A * 9/1984 Carte ..... 73/492
4,787,246 A * 11/1988 Komatsu et al. ..... 73/492
5,506,568 A 4/1996 Chen ..... 340/566
5,507,182 A * 4/1996 Yamada et al. ..... 73/504.03
5,585,566 A * 12/1996 Welles, II et al. ..... 340/669
5,664,665 A * 9/1997 Kobayashi et al. ..... 200/61.45
5,811,910 A * 9/1998 Cameron et al. ..... 310/324
6,040,625 A * 3/2000 Ip ..... 257/719
6,104,307 A 8/2000 Hanratty ..... 340/689
6,236,005 B1 * 5/2001 Kvisteroey et al. ..... 200/61.45
6,329,618 B1 * 12/2001 James et al. ..... 200/61.45
6,619,123 B2 * 9/2003 Gianchandani et al. .. 73/514.29

* cited by examiner

*Primary Examiner*—Jeffery Hofsass
*Assistant Examiner*—Daniel Previl
(74) *Attorney, Agent, or Firm*—Mark Homer

(57) ABSTRACT

The invention comprises a micromechanical shock sensor that is formed on the surface of a micro-substrate. A moveable proof mass is formed on the surface with at least one spring connected to the proof mass and the surface. The spring allows the proof mass to move a predetermined distance. Latching means are formed on the surface the predetermined distance from the proof mass. When the sensor is subjected to a sufficient shock, the proof mass moves and contacts the latching means. An indicator means is provided to allow this contact to be readily known by the user.

20 Claims, 4 Drawing Sheets

MICROMECHANICAL SHOCK SENSOR

STATEMENT OF GOVERNMENT INTEREST

The invention described herein may be manufactured and used by or for the Government of the United States of America for governmental purposes without payment of any royalties thereon or therefor.

BACKGROUND OF THE INVENTION

1. Field of the Invention

The present invention is micromechanical device on the order of 100 $\mu$m to 10 mm for indicating whether a shock has occurred, particularly detecting the presence of a shock when mounted to a package or object. More particularly the present invention is a no-power shock sensor that can be queried to indicate if the package or object has been subjected to a shock above a predetermined threshold.

2. Description of the Related Art

Shock sensors are used in many applications to monitor or detect shock forces imparted to an object that is fragile, under investigation, or of great value. Prior art shock sensors are frequently accelerometers utilizing sensing materials placed on a thin diaphragm with a proof mass attached to the diaphragm. Some of these devices also utilize materials having a piezoelectric effect, wherein the proof mass is carefully balanced above and below the diaphragm to avoid cross-axes sensitivity. One frequent use of mechanical shock detection devices is in the field of indicator alarms. Such alarms include those for sensing movement, time, temperature and a number of other physical parameters. Examples of such alarms include U.S. Pat. No. 5,506,568, which discloses a sensor for security systems that can sense sonic shocks and distinguish between natural sounds and the sound of a break-in; and U.S. Pat. No. 5,585,566, which discloses a shock detector for measuring intermittent shock events to assist in position tracking. One specific use of a mechanical shock detection device is for shipping where the sensor, mounted upon a package, will provide an indication of possible damage which occurs during shipment as a result of rough handling. One example of such a sensor can be found in U.S. Pat. No. 6,104,307, which discloses a condition responsive alarm system having a mount with an adhesive on the rear face and including a power source secured to the mount. A second example of such a sensor may be found in U.S. Pat. No. 5,811,910 which uses the piezoelectric material discussed above in order to detect shock in any direction.

However, for certain types of packages, including the shipment of warheads and explosives, the above referenced shock detection devices do not meet necessary size requirements, i.e. they are too heavy, and they all require power sources, which could present safety hazards when placed near explosive materials as well as lifecycle and reliability problems. Therefore, a shock sensor is desired that can detect a wide range of mechanical shock, yet is light weight and requires no external power source to operate.

SUMMARY OF THE INVENTION

The invention consists of a micromechanical device for sensing shock applied to packages containing explosives, weapons, or warheads. It is of particular importance to have information regarding forces that have been applied to explosives, weapons, or warheads during their transport both for safety reasons and to ensure that the explosive, weapon, or warhead operates properly when deployed during a critical mission. Current sensors do not meet the specific requirements for such a mission due to their heavy weight and because current sensors require their own power supply in order to operate. This invention was developed to address the above referenced need.

Accordingly, it is the object of this invention to provide a micromechanical shock sensor that is light weight.

It is a further object of this invention to provide a micromechanical shock sensor that requires no external power source.

It is a still further object of this invention to provide a micromechanical shock sensor that operates over a wide range of forces and in multiple directions.

This invention accomplishes these objectives and other needs related to detecting shock by providing a micromechanical shock sensor that is formed on the surface of a micro-substrate. A moveable proof mass is formed on the surface with at least one spring connected to the proof mass and the surface. The spring allows the proof mass to move a predetermined distance with a specified amount of resistance. Latching means are formed on the surface the predetermined distance from the proof mass. When the sensor is subjected to a sufficient shock, the proof mass moves and contacts the latching means. An indicator means is provided to allow this contact to be readily known by the user.

BRIEF DESCRIPTION OF THE DRAWINGS

The accompanying drawings, which are incorporated in and constitute a part of the specification, illustrate embodiments of the invention, and, together with the description, serve to explain the principles of the invention.

DESCRIPTION OF THE PREFERRED EMBODIMENT

The invention, as embodied herein, comprises a micromechanical shock sensor on the order of 200 to 500 microns for detecting shock from poor or rough handling of any items such as packages. The invention was designed to operate on or in items containing explosives, weapons, or warheads wherein such items are subjected to accelerations or shocks from about 1 to 50,000 gravities. As noted above, the invention requires no external power supply and is extremely light weight, with preferred weights of the sensor ranging from about 0.1 milligram to about 50 milligrams.

In general, the invention comprises a shock sensor that is formed on the surface of a micro-substrate. Using fabrication methods such as LIGA (a German acronym for lithography, electroplating, and molding) or DRIE (Deep Rective Ion Etching) processes, a moveable proof mass is formed on the surface with at least one spring connected to the proof mass and the surface. The spring allows the proof mass to move a predetermined distance with a specified resistance. Latching means are formed on the surface the predetermined distance from the proof mass. When the sensor is subjected to a sufficient shock, the proof mass moves and contacts the latching means. An indicator means is provided to allow this contact to be readily known by the user.

Figure 1:
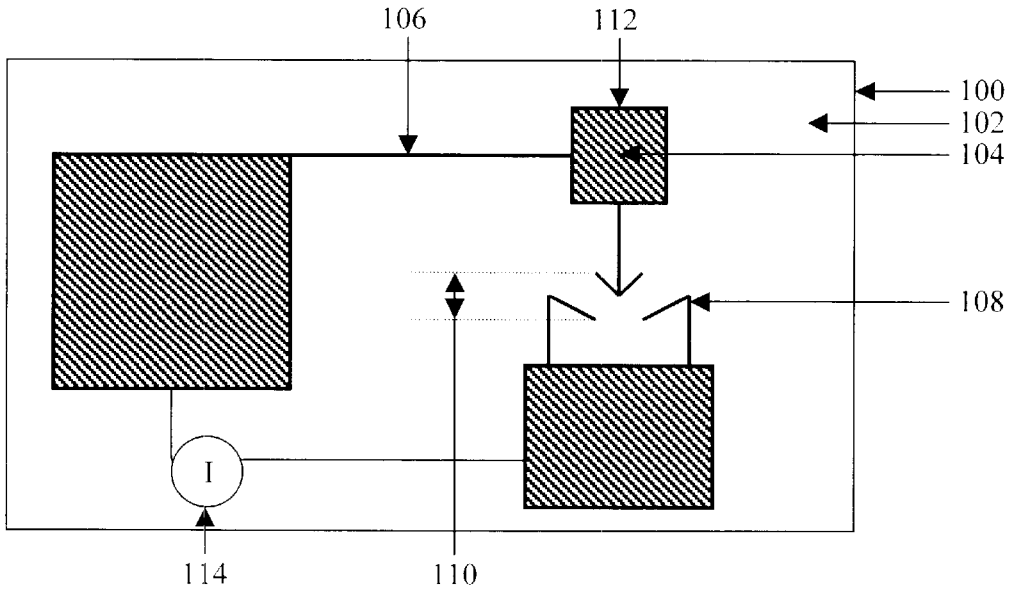
FIG. 1 is a top view of an embodiment of the invention.

Referring to FIG. 1, the invention comprises a micromechanical shock sensor device that is formed on a substrate 100 having a surface 102. The mechanical components can be formed using the micromechanical processing techniques noted above or using other micromechanical processing techniques known in the art. A moveable proof mass 104 is formed upon the surface 102 with at least one spring 106 also formed upon and attached to the surface 102. Holes in the proof mass 104 or other physical elements of the invention (not shown in the figure) may occur as a result of certain processing techniques used to form the proof mass 104 and have no bearing on the operation of the invention. The spring 106 is attached to the proof mass 104, allowing the proof mass 104 to move when subjected to a force. A latching means 108 is formed on the surface 102 a predetermined distance 110 from the proof mass 104. The predetermined distance 110 is determined dependant upon the desired spring design, the latch design, and the magnitude of the predetermined force 112, along the plane of the formation of the sensor, that one attempts to sense using the device. When the magnitude of the predetermined force 112 acts upon the proof mass 104, the proof mass 104 moves the predetermined distance 110 and contacts the latching means 108. An indicator means 114 allows the user to know that the proof mass 104 has contacted the latching means 108.

Figure 2:
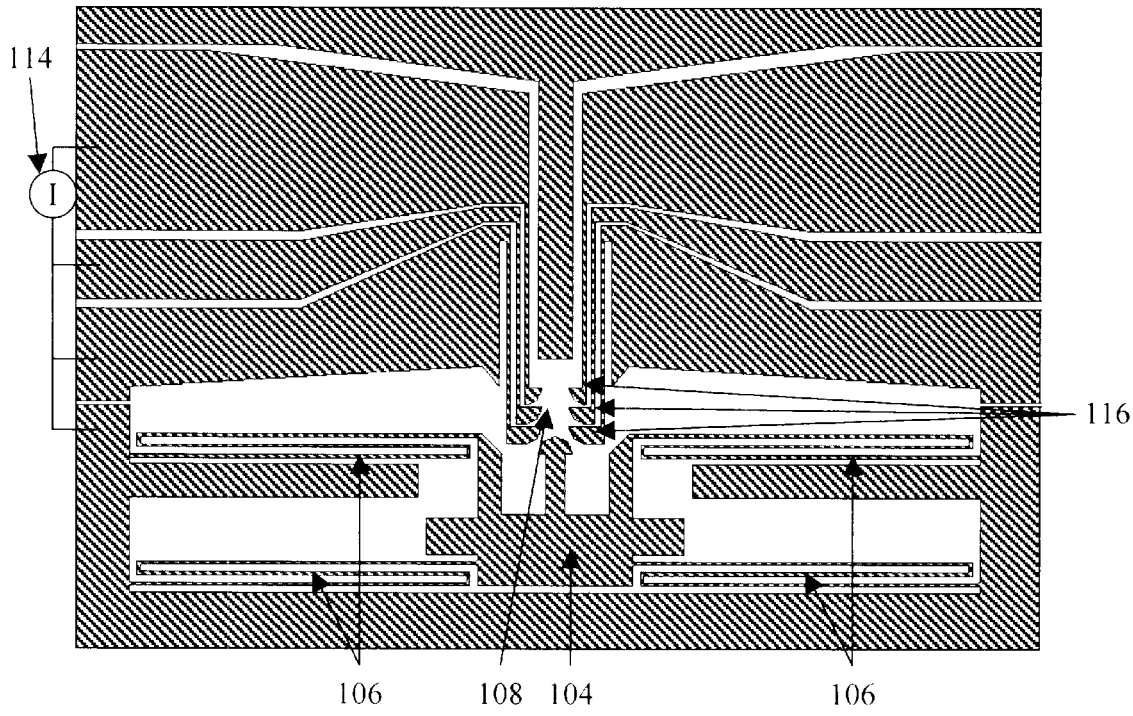
FIG. 2 is a top view of an embodiment of the invention showing multiple springs and multiple detection levels.

Referring to FIG. 2, the spring 106, preferably, is formed using one or more straight, folded, or curved beams. This is due to the complexity of the micromachining process. Preferred embodiments of the invention comprise a plurality of springs 106 used to guide the proof mass 104 with most preferred embodiments using two or four springs 106.

Figure 3:
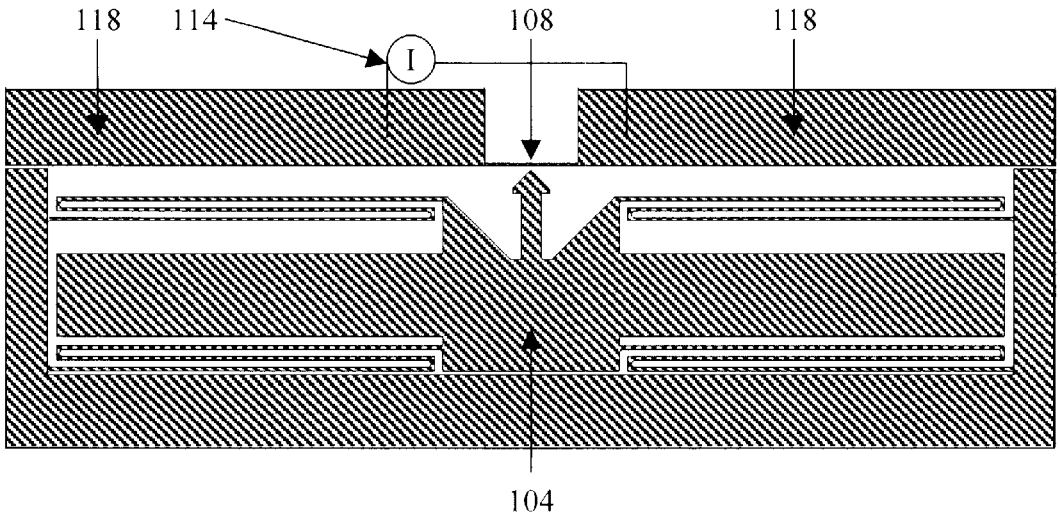
FIG. 3 is a top view of an embodiment of the invention wherein the latching means comprises a thin beam.
Figure 4:
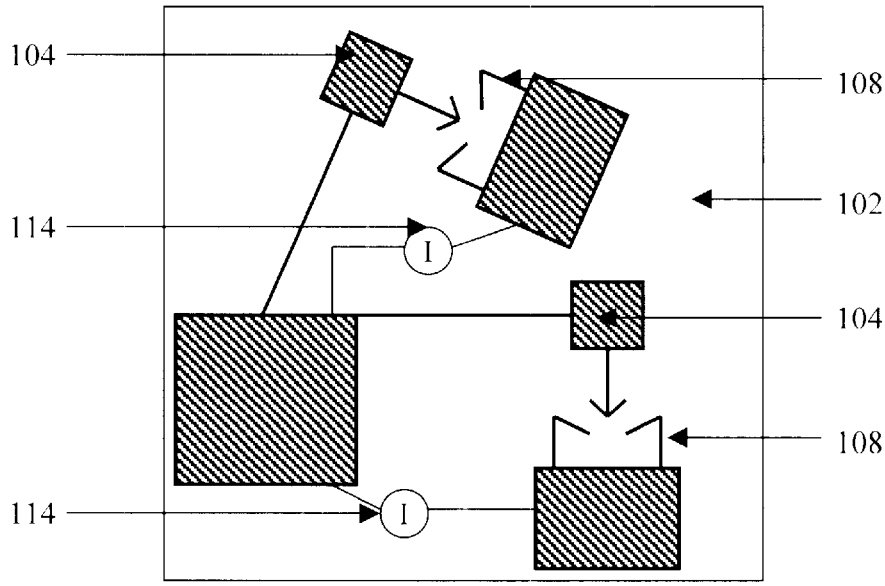
FIG. 4 is a cross-sectional, side view of an embodiment of the invention showing two sensors at different angles along the substrate.
Figure 7:
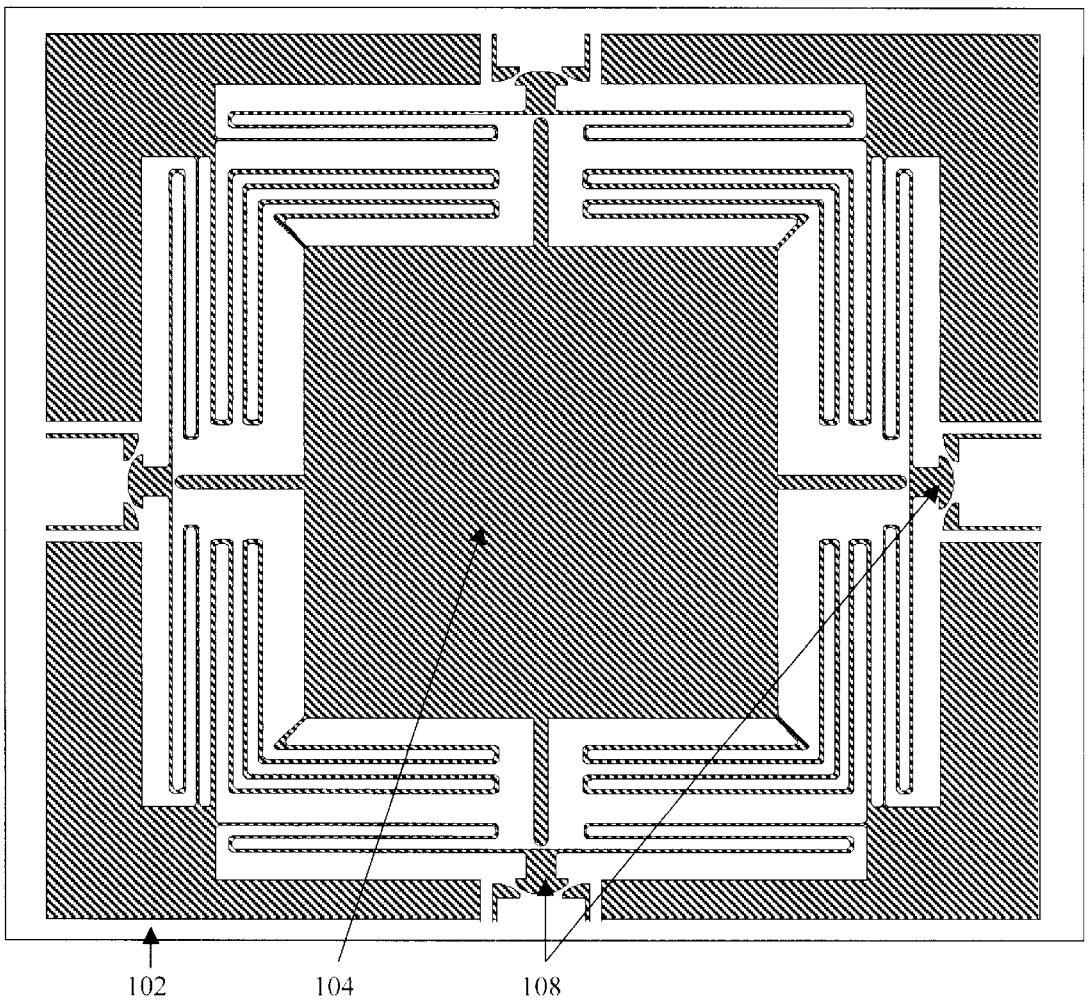
FIG. 7 is a top view of an embodiment of the invention showing multi-directional sensing means.

The latching means 108 may be selected by one skilled in the art dependent upon the specific use of the sensor contemplated. In one embodiment of the invention, the latching means 108 may merely comprise a type of switch wherein the switch closes when the proof mass 104 contacts the latching means 108. In another embodiment of the invention, the latching means 108 actually comprises a switch that holds the proof mass 104 in place after the two objects make contact. In a further embodiment of this type, the latching means 108 may comprise a plurality of levels 116 wherein the latching means 108 holds the proof mass 104 proximate to one of the different levels 116 dependent upon the amount of force 112 applied to the proof mass 104. In this embodiment, the indicator means 114 would indicate at which level the latching means 108 holds the proof mass 104. In yet another embodiment of the invention set forth in FIG. 3, the latching means 108 may comprise a thin beam that is broken when the proof mass 104 contacts the latching means 108. In this embodiment, the indicator means 114 would indicate that the preclosed circuit 118 had been opened. In one last embodiment of the invention set forth in FIG. 3, multiple latching means 108 and proof masses 104 may be placed on the surface 102. One such embodiment, shown in FIG. 7, could place several latching means 108 around one proof mass 104, thereby allowing the proof mass 104 to move in multiple directions and still contact a latching means 108. Another such embodiment, specifically set forth in FIG. 3, comprises multiple latching means 108 and proof mass 104 combinations placed upon the surface 102 at different angles in order to measure shock along multiple directions. In this embodiment, multiple indicator means 114 would be necessary to show the user that one of the latching means 108 had been contacted by one of the proof masses 104.

The indicator means 114 need to show the user that the latching means 108 has been contacted by the proof mass 104 and may also be selected by one skilled in the art. In one preferred embodiment of the invention, the indicator means 114 comprises an electrical switch so that the contact by the proof mass 104 and the latching means 108 completes a circuit for the electrical switch. This would allow the user to user to apply many devices, known in the art, that indicate the difference between a closed and open electrical circuit to determine the status of the sensor. Preferably, a hand-held device would be employed for this purpose. In one preferred embodiment of the invention the surface is coated to provide increased conductance in order to more easily determine the open or closed status of the switch. Many such coatings are known in the art with one example being a gold coating.

Figure 5:
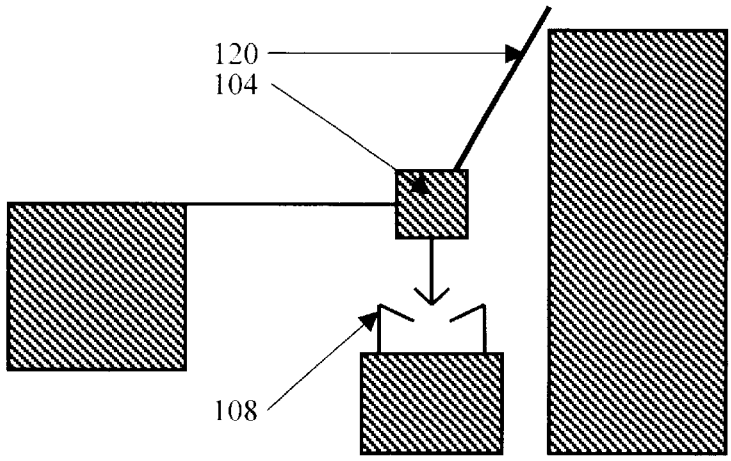
FIG. 5 is a top view of an embodiment of the invention showing a damping means.

Referring to FIG. 5, one embodiment of the invention includes damping means 120. The damping means may be selected by one skilled in the art but could include beams formed on the surface proximate to the sides of the proof mass 104. The damping means 120 dampen small amounts of normal vibration to ensure that slight vibrations are not added together to cause the proof mass 104 to move into contact with the latching means 108 without a single specific shock. Damping also allows the dynamic response of the sensor to be tuned to measure the desired shock signature.

Figure 6:
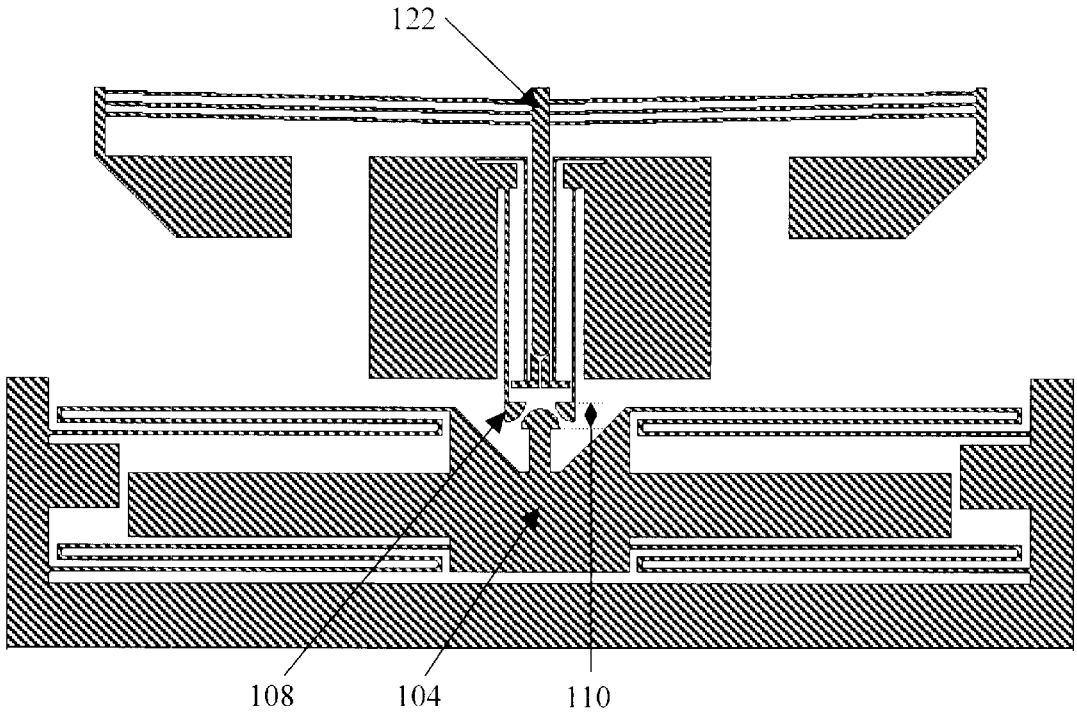
FIG. 6 is a top view of an embodiment of the invention showing a releasing means.

Referring to FIG. 6, one embodiment of the invention includes an unlatching means 122 to release the proof mass 104 from the latching 108 means wherein the proof mass 104 returns to the predetermined distance 110 from the latching means 108. This would allow the device to be reused. In one embodiment of the invention, the unlatching means 122 comprises at least one electronically activated actuator.

As noted above, the sensor is designed to be very small. The acceleration range noted above, from about 1 to 50,000 gravities, relates to a predetermined force 112 upon the proof mass 104 from about 1 micronewton to about 10 micronewtons. A preferred predetermined distance 110 comprises from about 50 microns to about 300 microns.

Finally, the invention also comprises a method for detecting shock applied to items by taking one of the embodiments of the invention described above and attaching it to the item. If the item is subjected to the type of shock described above, then the indicator within the sensor should be activated.

What is described are specific examples of many possible variations on the same invention and are not intended in a limiting sense. The claimed invention can be practiced using other variations not specifically described above.

What is claimed is:

1. A micromechanical shock sensor device, comprising:

a substrate having a surface;

a moveable proof mass formed upon the surface;

at least one spring formed upon and attached to the surface, and attached to the proof mass wherein the proof mass may move a predetermined distance when subjected to a force of a predetermined magnitude;

latching means formed upon and attached to the surface the predetermined distance from the proof mass wherein the proof mass moves the predetermined distance and contacts the latching means when the proof mass is subjected to the force of a predetermined magnitude; and, indicator means to indicate that the proof mass has contacted the latching means.

2. The micromechanical shock sensor device of claim 1, wherein the indicator means comprises an electrical switch so that the contact by the proof mass and the latching means completes a circuit for the electrical switch.

3. The micromechanical shock sensor of claim 2, further comprising a plurality of springs formed upon the surface attached to the proof mass.

4. The micromechanical shock sensor of claim 3, further comprising a plurality of latching means formed upon and attached to the surface the predetermined distance and a plurality of proof masses formed upon the surface wherein the plurality of proof masses move the predetermined distance toward any of the plurality of latching means when subjected to the force of a predetermined magnitude.

5. The micromechanical shock sensor of claim 1, wherein the latching means comprises a plurality of levels wherein the latching means holds the proof mass proximate to a different level dependent upon a predetermined amount of force applied to the proof mass.

6. The micromechanical shock sensor of claim 5, wherein the indicator means may indicate which of the plurality of levels the proof mass is held proximate to.

7. The micromechanical shock sensor of claim 1, wherein the latching means holds the proof mass proximate to the latching means after the proof mass contacts the latching means.

8. The micromechanical shock sensor of claim of claim 7, further comprising an unlatching means to release the proof mass from the latching means wherein the proof mass returns to the predetermined distance from the latching means.

9. The micromechanical shock sensor of claim 8, wherein the unlatching means comprises at least one electronically activated actuator.

10. The micromechanical shock sensor of claim 7, further comprising damping means proximate to the proof mass wherein the proof mass does not contact the latching means as a result of a build up of small vibrations or resonance.

11. The micromechanical shock sensor of claim 2, wherein the latching means comprises a thin beam wherein the proof mass breaks the thin beam upon contact and opens the electrical switch.

12. The micromechanical shock sensor of claim 1, further comprising:

a second proof mass formed on the surface at an angle to the first proof mass;

a second spring formed on the surface at the angle of the second proof mass wherein the proof mass may move the predetermined distance;

a second latching means formed on the surface, the predetermined distance from the second proof mass and at the angle of the second proof mass wherein the second proof mass moves the predetermined distance as a result of the force of a predetermined magnitude and contacts the second latching means; and, a second indicator means to indicate that the second proof mass has contacted the second latching means wherein the shock sensor operates in a plane substantially parallel to the proof mass and in a plane substantially parallel to the second proof mass.

13. The micromechanical shock sensor of claim 1, wherein the spring comprises one or more beams wherein the beams may be selected from straight, folded or curved.

14. The micromechanical shock sensor of claim 1, wherein the sensor may detect a shock from about 1 gravity to about 50,000 gravities.

15. The micromechancial shock sensor of claim 1, wherein the force of a predetermined magnitude comprises from about 1 micronewton to about 10 micronewtons.

16. The micromechanical shock sensor of claim 1, wherein the predetermined distance comprises from about 50 microns to about 300 microns.

17. The micromechanical shock sensor of claim 1, further comprising a mass from about 0.1 milligrams to about 50 milligrams.

18. The micromechanical shock sensor of claim 1, further comprising a coating applied to the substrate wherein the increases the conductance of the substrate.

19. A method for detecting shock applied to packages, comprising the steps of providing a micromechanical shock sensor comprising a substrate having a surface, a moveable proof mass formed upon the surface, at least one spring formed upon and attached to the surface, and attached to the proof mass wherein the proof mass may move a predetermined distance when subjected to a force of a predetermined magnitude, latching means formed upon and attached to the surface the predetermined distance from the proof mass wherein the proof mass moves the predetermined distance and contacts the latching means when the proof mass is subjected to the force of a predetermined magnitude, and, indicator means to indicate that the proof mass has contacted the latching means; and, attaching the shock sensor to the package.

20. The method of claim 19, further comprising four springs formed upon and attached to the surface, and attached to the proof mass.

* * * * *